US005355591A

United States Patent [19]

Caruso

[11] Patent Number: 5,355,591

[45] Date of Patent: * Oct. 18, 1994

[54] STEAMER ATTACHMENT FOR A HAIR CURLER STEAMER

[76] Inventor: Richard Caruso, 619 Croyden Rd., Cheltenham, Pa. 19102

[ * ] Notice: The portion of the term of this patent subsequent to Jul. 20, 2010 has been disclaimed.

[21] Appl. No.: 10,996

[22] Filed: Jan. 29, 1993

Related U.S. Application Data

[63] Continuation-in-part of Ser. No. 863,449, Apr. 3, 1992, Pat. No. 5,228,213.

[51] Int. Cl.[5] ..... F26B 19/00

[52] U.S. Cl. ..... 34/60; 34/98; 34/90; 34/91; 392/386; 392/394; 4/537

[58] Field of Search ..... 34/96, 97, 98, 202, 34/12, 60, 61, 104, 90, 91; 392/380, 386, 394, 404, 397; 4/536, 537

[56] References Cited

U.S. PATENT DOCUMENTS

| | | | |
|---|---|---|---|
| 2,881,755 | 4/1959 | Diehl | 392/404 |
| 3,120,851 | 2/1964 | Pollak et al. | 132/9 |
| 3,493,722 | 2/1970 | Popeil | 219/222 |
| 3,495,343 | 2/1970 | Duncanson | 34/98 |
| 3,495,583 | 2/1970 | Katzman et al. | 126/381 |
| 3,645,007 | 2/1972 | Scott | 392/394 |
| 4,308,670 | 1/1982 | Bonnema | 34/97 |
| 4,314,138 | 2/1982 | Itoh | 219/276 |
| 4,361,966 | 12/1982 | Downey | 34/99 |
| 4,366,368 | 12/1982 | Stephens, III | 34/97 |
| 4,391,047 | 7/1983 | Janssens et al. | 34/97 |
| 4,538,362 | 9/1985 | Andis | 34/97 |
| 4,621,641 | 11/1986 | Frank et al. | 128/368 |
| 4,759,135 | 7/1988 | Scivoletto | 34/97 |
| 4,816,644 | 3/1989 | Frank | 219/271 |
| 5,010,905 | 4/1991 | Snyder et al. | 4/537 |
| 5,228,213 | 7/1993 | Caruso | 34/90 |

*Primary Examiner*—Denise Gromada
*Attorney, Agent, or Firm*—Woodcock Washburn Kurtz Mackiewicz & Norris

[57] ABSTRACT

An attachment is provided for converting a table top steamer into an apparatus for steam treatment of the body. The attachment comprises an approximately cylindrical conduit having open ends and a plurality of holes located between the first and second ends. The conduit divides the steam jet discharged from the steamer into three streams and diffuses and cools the steam in each of these streams, thereby allowing the face and both hands of the user may be simultaneously steam treated. The attachment is locked onto the steamer by a pair of flexible tabs extending from the sides of the conduit. The tabs have holes formed therein that secure them to retainers extending from the steamer by means of a snap fit.

20 Claims, 6 Drawing Sheets

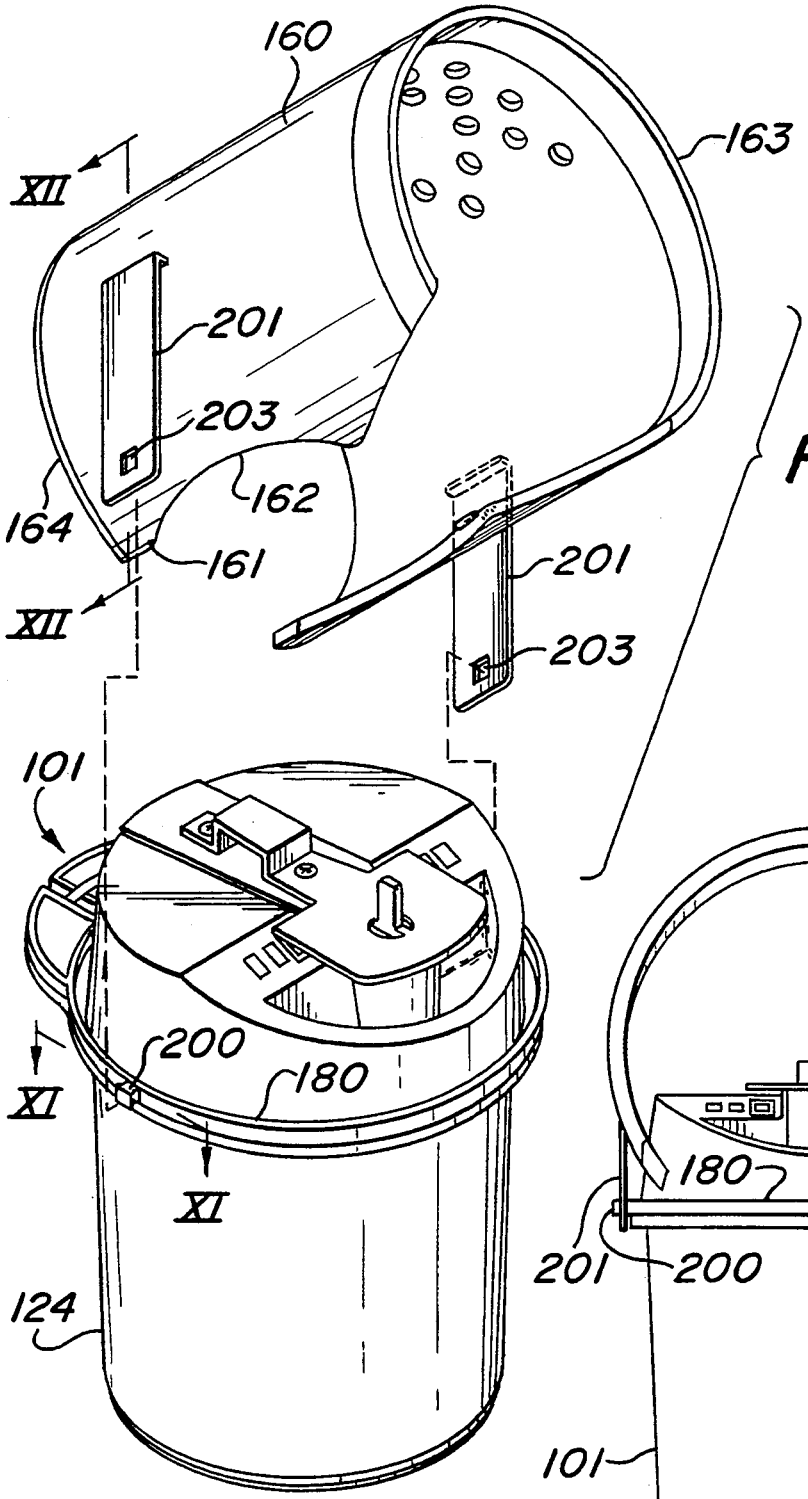
FIG. 9
FIG. 10
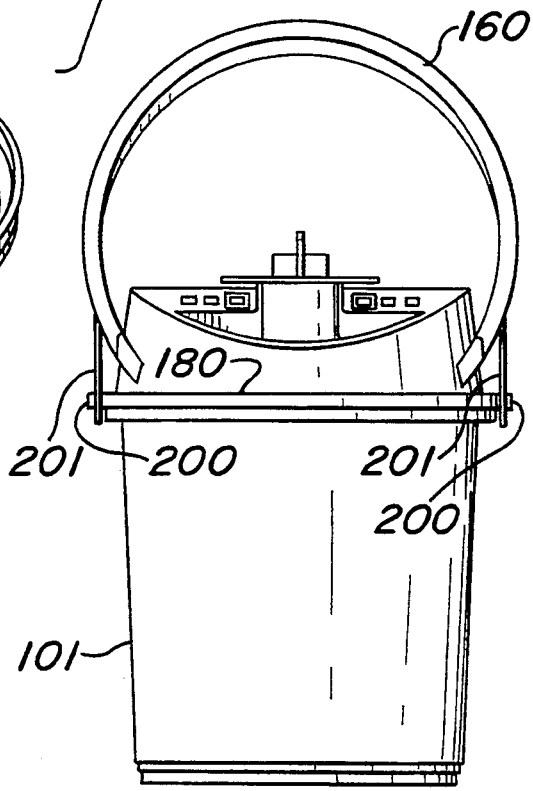

FIG. 11
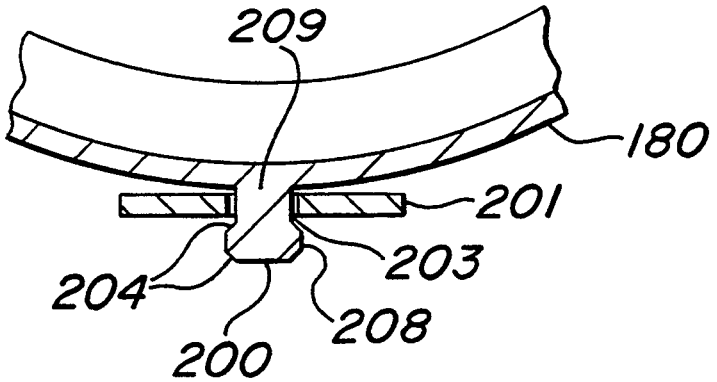
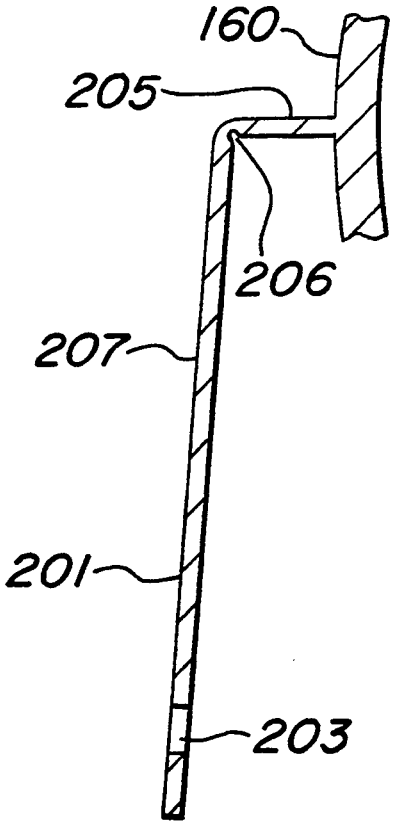
FIG. 12

STEAMER ATTACHMENT FOR A HAIR CURLER STEAMER

REFERENCE TO RELATED APPLICATION

This application is a continuation-in-part of copending application U.S. Ser. No. 863,449, filed Apr. 3, 1992, now U.S. Pat. No. 5,228,213issued Jul. 20, 1993, the disclosure of which is hereby incorporated by reference in its entirety.

FIELD OF THE INVENTION

The current invention is directed to an apparatus for steaming the face and hands. More specifically, the current invention is directed to an attachment for converting a hair curler steamer into a facial/hand steamer.

BACKGROUND OF THE INVENTION

In the past, hair curling systems have been developed that apply steam to hair curlers as an aid to curling. One such system is disclosed in U.S. Pat. No. 3,493,722 (Popeil) and involves soaking an entire set of curlers in a steam chest. A more advanced system is disclosed in U.S. Pat. No. 4,453,554 (Caruso) and involves injecting a jet of steam into a porous hollow curler. Such steam hair curling systems utilize a steam generating unit, typically referred to as a "steamer." Although such steamers are designed primarily for the generation of steam for hair curlers, attempts have been made to adapt them for use as a facial Steamer, as disclosed in the aforementioned Popeil patent.

According to Popeil, a shield is placed within the steam chest to guide the steam vertically upward for steaming the face. Unfortunately, this approach suffers from several drawbacks. First, whereas the user often desires to steam both the hands and the face, Popeil only allows steaming of only one body part at a time. Second, the shield is not suitable for converting a more advanced curler system steamer, such as that disclosed in the aforementioned patent to Caruso, to body steaming. This is so because the Popeil shield merely directs the steam flow upward, it neither diffuses nor cools the steam. This is a serious drawback since advanced steamers generate steam in a relatively high velocity jet that cannot be safely discharged directly into the user's face.

Accordingly, it would be desirable to provide an attachment for a hair curler steamer that was capable of providing steam for steam treating the user's face and/or hands, and for providing a means for securely locking the attachment onto the steamer.

SUMMARY OF INVENTION

It is an object of the current invention to provide an attachment for a hair curler steamer that is capable of providing steam for steam treating the user's face and/or hands, and for providing a means for securely locking the attachment onto the steamer. This object, as well as other objects, is accomplished in a steamer for steam treating a user's body, comprising a steam flow generating unit and a steam flow directing means. The steam flow generating unit has a vessel forming a cavity for containing water and means for transforming at least a portion of the water contained in the cavity to a flow of steam. The steam flow directing means has a steam flow discharging means for directing at least a first portion of the steam flow from the steam flow generating unit in a first substantially horizontal direction and means for locking the steam flow directing means onto the steam flow generating unit.

In a preferred embodiment of the invention, the locking means comprises a tab extending between the steam flow directing means and the steam flow generating unit and a retainer for releasably securing the tab.

BRIEF DESCRIPTION OF THE DRAWINGS

FIG. 9 is an isometric exploded view of the steamer of FIG. 1 after being converted to a facial/hand steamer by the attachment of an alternate embodiment of the current invention.

FIG. 10 is an elevation of the steamer and attachment shown in FIG. 9.

FIG. 11 is a cross-section through lines XI—XI shown in FIG. 10.

FIG. 12 is a cross-section through lines XII—XII shown in FIG. 10.

DESCRIPTION OF THE PREFERRED EMBODIMENT

Figure 1:
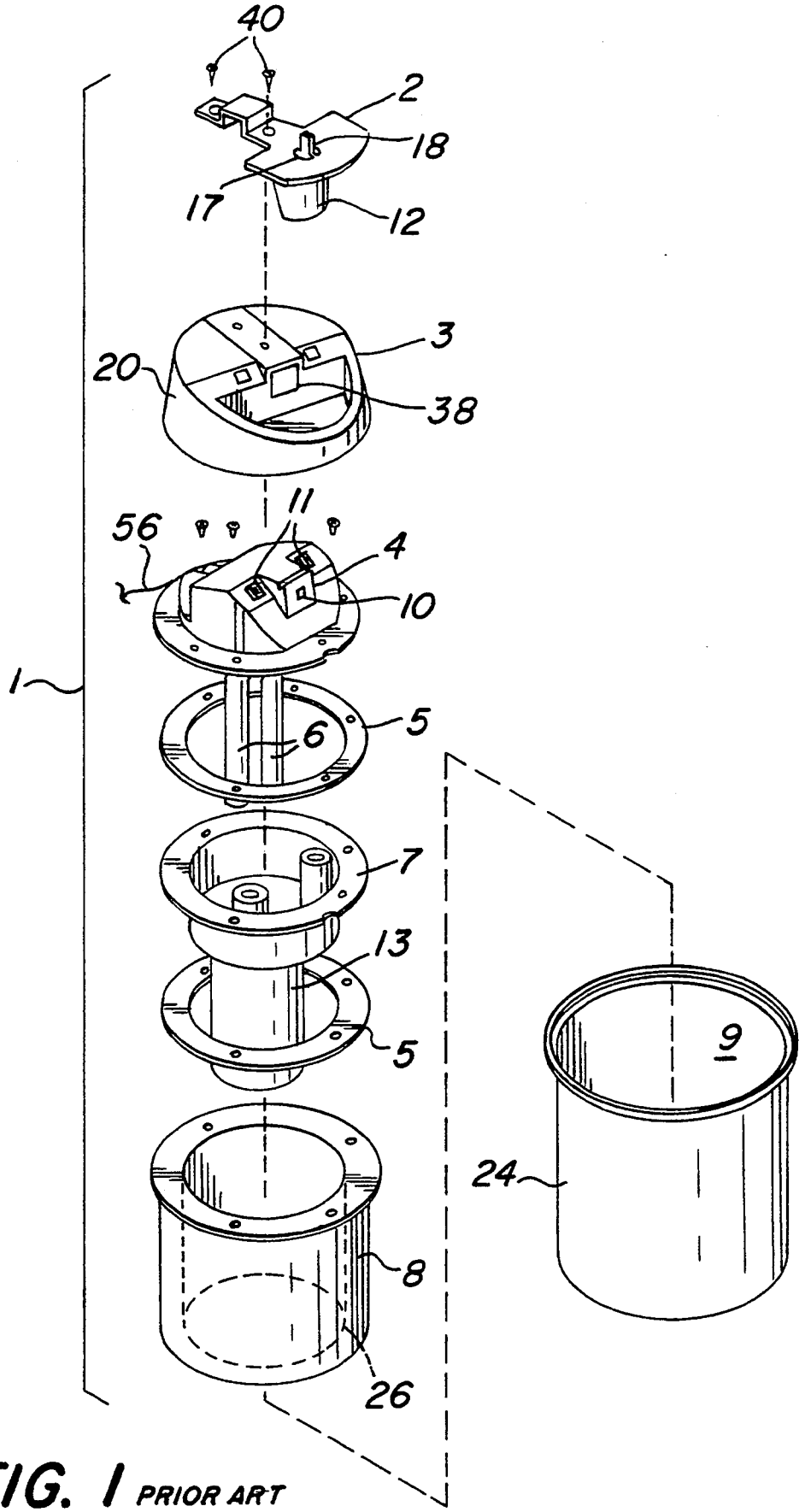
FIG. 1 PRIOR ART
FIG. 1 is an exploded view of a hair curler steamer according to the prior art.

Referring to the drawings in detail, wherein like numerals indicate like elements, there is shown in FIG. 1 a table top steamer 1 according to the prior art, such as heretofore used in conjunction with porous hollow hair curlers disclosed in the aforementioned U.S. Pat. No. 4,453,554 (Caruso), hereby incorporated by reference in its entirety. The steamer 1 comprises an outer vessel 24 that forms a cavity 9 for containing the water to be transformed into steam. An outer housing 8, having an inner cylinder 26 concentrically disposed therein, is mounted into the vessel 24. An inner housing 7, having a shroud 13 extending downward therefrom, is disposed within the outer housing 8 and sealed thereto by a gasket 5.

As shown in FIG. 1, an inner cap 4, having electrodes 6 mounted therein for heating the water and thereby transforming it into steam, is disposed within the inner housing 7 and sealed thereto with a second gasket 5. Power cables 56 are connected to the electrodes 6. A steam discharge port 10, in flow communication with the cavity 9, is formed in the inner cap 4. In addition, steam vents 11, adapted to vent excess steam to atmosphere when steaming hair curlers, are formed on either side of the steam port 10. A cover 3 having a cylindrical portion 20 is mounted atop the inner cap 4. A steam port 38 is formed in the cover 3 that is concentric with, and therefore in flow communication with, the inner cap steam port 10. Lastly, a plastic handle/curler support 2 is attached to the cover 3 via screws 40.

Figure 3:
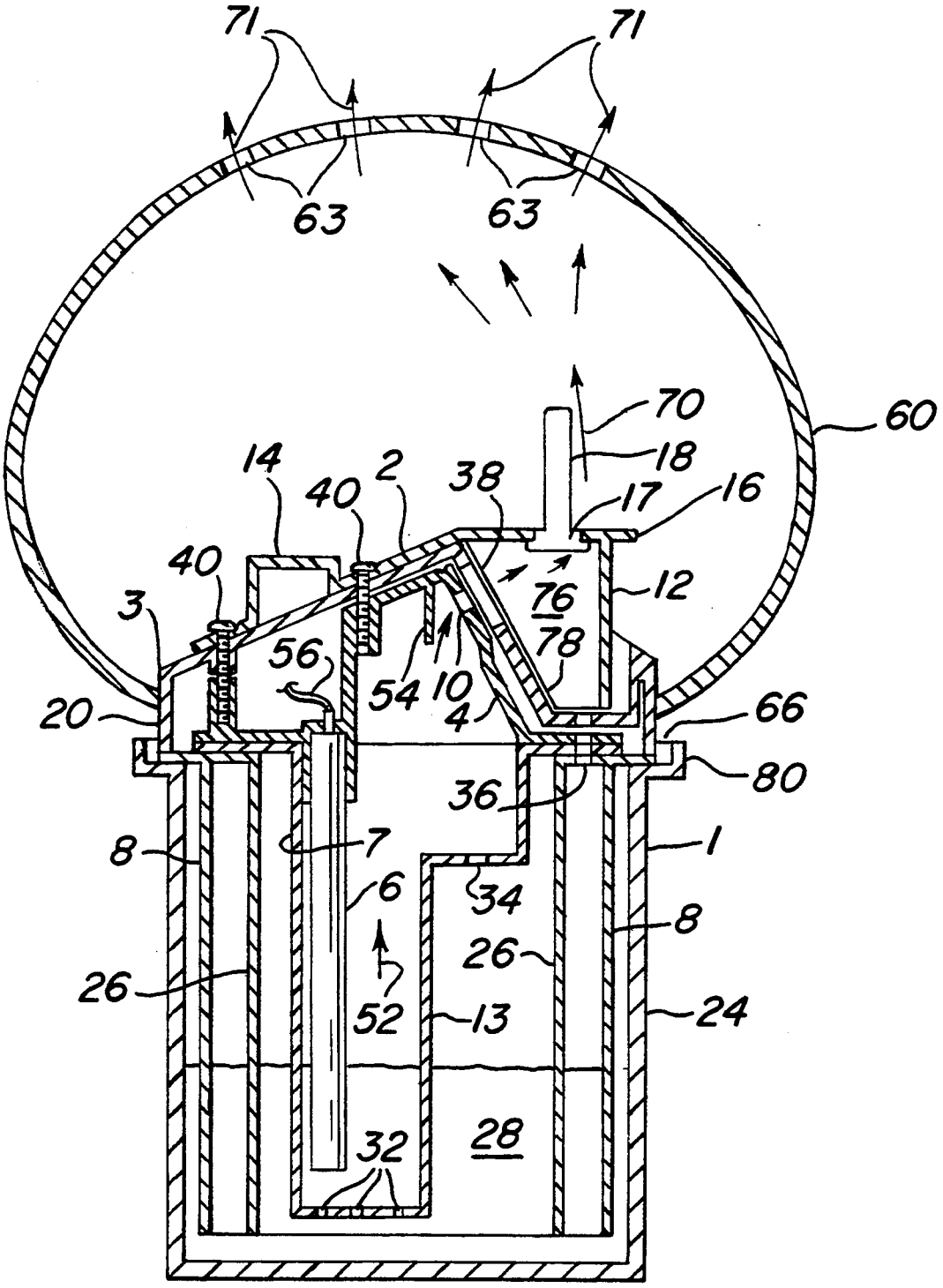
FIG. 3 is a cross-section taken through line III—III shown in FIG. 2.

As shown in FIG. 3, the handle/curler support 2 has a finger grip portion 14, disposed between the attaching screws 40, to facilitate lifting of the steamer 1. A planar portion 16 extends forwardly from the finger grip portion 14. When operating in the hair curler steaming mode, a hair curler (not shown) is placed over a post 18 extending upward from the support 2 and allowed to rest on the planar portion 16. Steam from the inner cap steam port 10 is introduced into the curler via a steam port 17 formed in the planar portion 16. In addition to supporting the curler, the planar portion 16 also serves as a baffle to deflect excess steam discharging from the vents 11 away from the user. A cowl 12 extends downwardly from the planar portion 16 and partially encircles the steam ports 10 and 38. As a result, the cowl 12, in cooperation with the face of the cover 3, forms a sealed conduit for directing the steam generated by the electrodes 6 so that the steam is discharged as a jet of steam 70 through the port 17 into the curler steam passage.

Figure 4:
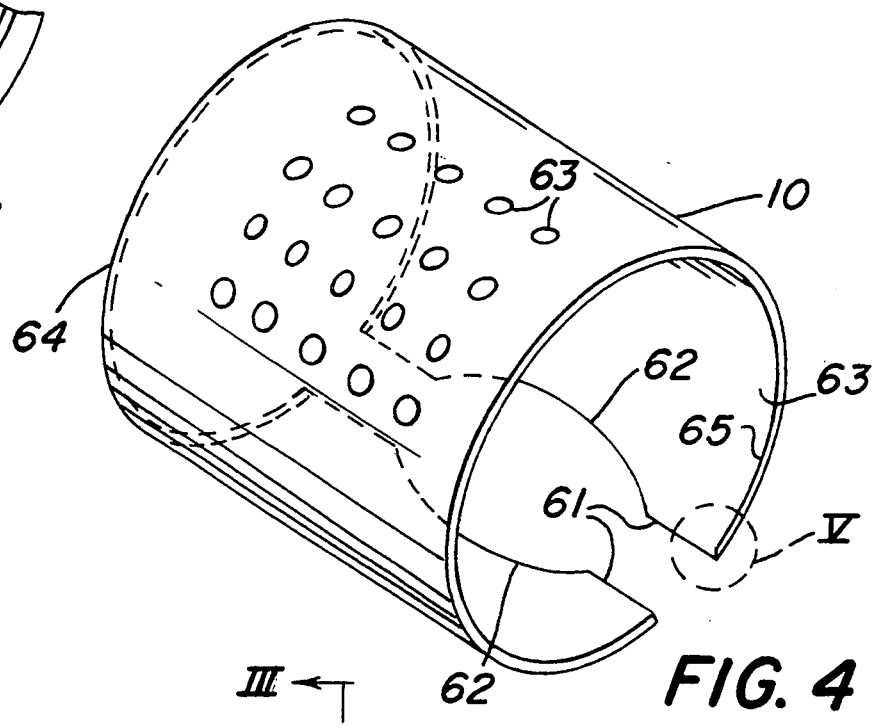
FIG. 4 is an isometric view of the steamer attachment shown in FIG. 2.
Figure 2:
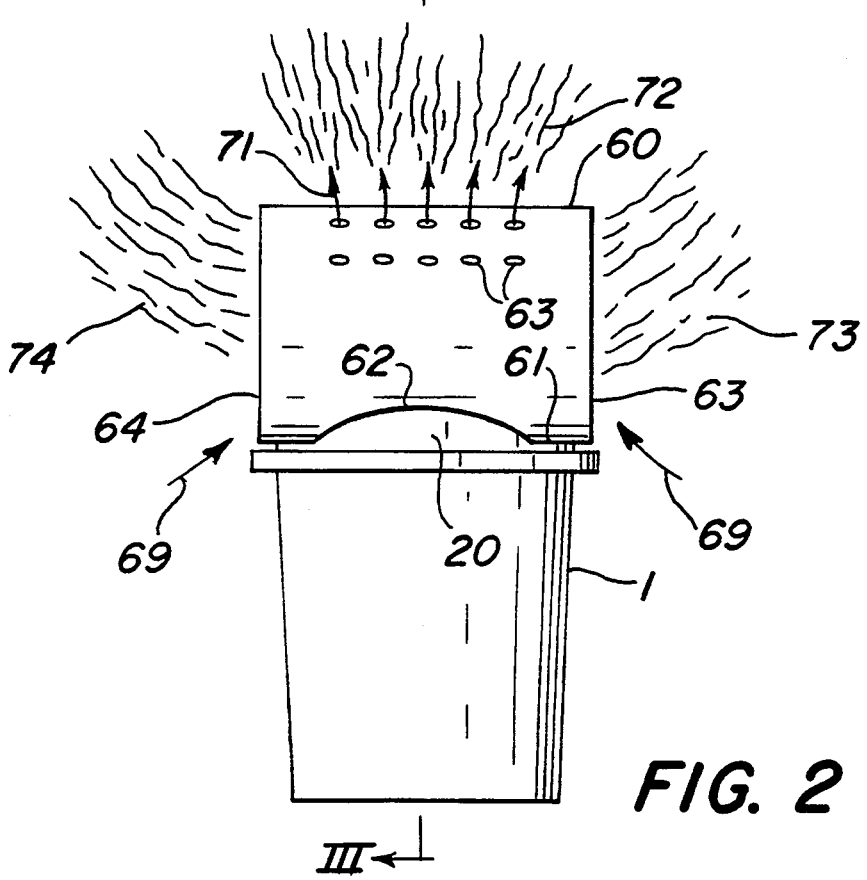
FIG. 2 is an elevation showing the steamer of FIG. 1 after being converted to a facial/hand steamer by the attachment of the current invention.

As shown in FIGS. 2 and 3, the steamer 1 is converted for use as a facial/hand steamer by the addition of an attachment, shown in FIG. 4. The attachment comprises an approximately cylindrical conduit 60, preferably formed from a flexible plastic. The conduit 60 is open at both of its ends 63 and 64 and has two longitudinally extending edges 61. Scallops 62, having a radius of curvature matching that of the cylindrical portion 20 of the cover 3, are formed in each of the edges 61. A pattern of holes 63 are formed in one quadrant of the conduit 60.

In one embodiment of the current invention, the conduit 60 is secured to the steamer 1 by a compression fit. When the conduit 60 is in its undeformed state, the maximum distance between the scallops 62 in the edges 61 is less than the diameter of the cylindrical portion 20 of the cover 3. Since the conduit 60 has considerable flexibility, this feature allows it to be secured to the steamer 1 by a compression fit. Specifically, the edges 61 are manually spread apart so as to elastically deform the conduit. The conduit 60 is then placed over the cover 3 with its longitudinal axis horizontally oriented. When the conduit 60 is released, the edges 61 are urged against the cylindrical portion 20 of the cover 3 by the remaining elastic deformation, thereby providing a secure method of attaching the conduit 60 to the cover 3. As result of the elastic deformation, a substantially cylindrical conduit 60, such as that shown in FIG. 4, may assume a somewhat elliptical shape when attached to the steamer 1.

Figure 6:
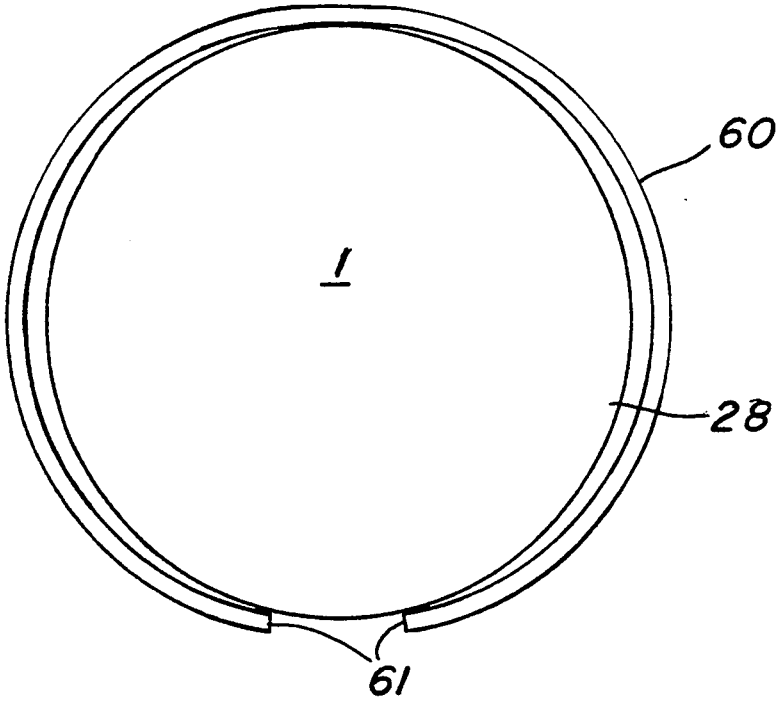
FIG. 6 is a view from below of the steamer with the attachment according to the current invention secured for storage when not in use.

In the preferred embodiment, the diameter of the conduit 60 is slightly less than the diameter of the vessel 28 and the length of the conduit is less that the height of the vessel. This allows the conduit 60 to be conveniently stored on the steamer 1 when not in use by slipping the conduit around the vessel 28, as shown in FIG. 6, so that it remains secured by an interference fit created by elastic deformation.

As shown in FIG. 3, in operation, the electrodes 6 heat the water 28 contained in the vessel 24—more specifically, they heat the portion of the water 28 that flows into the shroud 13 of the inner housing 7 via holes 32—thereby forming steam 52. The steam 52 is directed by baffle 54 to flow outward through the steam ports 10 and 38 in the inner cap 4 and cover 3, respectively, into the chamber 76 formed by the cowl 12. Any additional steam generated in the water 28 outside of the shroud 13 flows into the inner housing via hole 34 and into the chamber 76 via holes 36.

From the chamber 76, the steam discharges the steamer 1 through steam port 17 as a relatively high velocity jet of steam 70. The steam jet 70 strikes the inner surface of the conduit 60 and is divided into three streams. The first stream comprises a plurality of small steam streams 71 that are directed vertically upward by the conduit 60 so as to discharge through the holes 63 that are disposed in the top quadrant of the conduit. Just above the conduit 60, the streams 71 merge into an upward flowing mist 72 of steam especially suitable for a steam treatment of the face, as shown in FIG. 2. Advantageously, as a result of flowing through the holes 63 and coming into contact with a flow of air, induced as discussed below, the steam jet 70 has been diffused and cooled, thereby eliminating the possibility of scalding the user. The second and third streams 73 and 74 are directed by the conduit 60 to flow horizontally outward in 180° opposed directions, discharging through the open ends 63 and 64 of the conduit.

As shown in FIG. 2, the flow of steam 71 through the holes 63 in the top quadrant of the conduit provides aspiration by drawing air 69 into the conduit. The air 69 mixes with the steam streams 71, 73 and 74 aiding in their diffusion and cooling, thereby eliminating the possibility of scalding the user.

The steamer attachment according to the current invention serves to divide the steam 70 discharging from the steam port 17 into three separate Streams 72, 73 and 74 and to direct these streams so that they may be used to simultaneously steam various parts of the body. As can readily be appreciated, this arrangement provides considerable flexibility. Thus, the user can be placed directly in front of the steamer—that is, facing into the paper as viewed in FIG. 2—with the hands placed around the steamer so that the right hand is opposite opening 63 and the left hand is opposite opening 64, thereby allowing steam streams 73 and 74 to treat the right and left hands, respectively, simultaneously. In addition, the user can bend forward so as to place the face over the top of the steamer, thereby allowing steam stream 72 to treat the face simultaneously with the hands. Alternatively, the user can be positioned to the right side of the steamer, as viewed in FIG. 2, with the hands placed around to the left side so that steam stream 73 treats the face, neck and chest while steam stream 64 treats the hands of the user.

Thus, the attachment according to the current invention allows the simultaneous steam treatment of several body parts, such as the face and hands. In addition, the attachment diffuses the steam jet 70 and allows it to cool somewhat into a moist vapor that will achieve the desired benefits without danger of scalding the user, especially in the sensitive face area.

Figure 5:
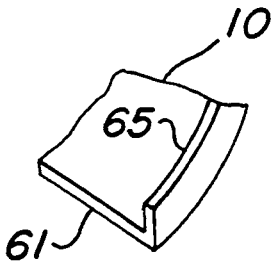
FIG. 5 is a detailed view of the portion of FIG. 4 enclosed by the circle marked V.

As shown in FIG. 5, circumferentially extending baffles 65 are formed at each of the ends 63 and 64 of the conduit 60. These baffles act as gutters to direct condensation formed on the inside surface of the conduit to a channel 66 formed between a lip 80 in the outer vessel 24 and the cover 3, as shown in FIG. 3, thereby preventing the condensate from dripping onto the table top or other surface on which the steamer 1 is supported.

Figure 7:
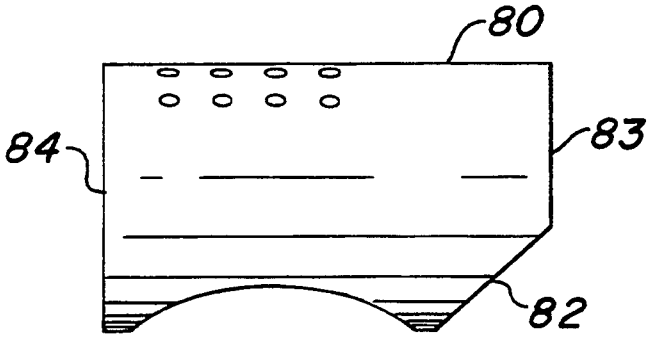
FIGS. 7 and 8 show two alternate embodiments of the attachment of current invention.
Figure 8:
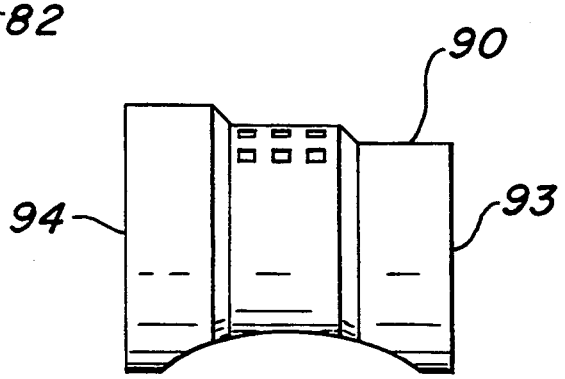

Although a simple cylindrical shape has been shown for the conduit in FIGS. 1-6, other shapes such as that shown in FIG. 7, in which the conduit 80 has a bevel edge on end 82, and that shown in FIG. 8, in which the conduit 90 is formed by concentric cylinders of varying diameter, can also be used. Such shapes may render the attachment more aesthetically appealing but can also be advantageously employed to adjust the amount of steam or the ratio of the amount of steam to the amount of aspirated air flow at each end of the attachment—for example, in attachment 90 shown in FIG. 8 the amount of steam flow from end 94 can be expected to be greater than from smaller end 93, making end 94 more suitable for steaming the face and chest and end 94 more suitable for steaming the hands. Alternatively, in the attachment 80 shown in FIG. 7 the degree of cooling due to contact with the aspirated air flow can be expected to be greater at end 83 than at end 84 due to the presence of the bevel 82, making end 83 more suitable for use in treating the face and end 84 more suitable for treating the hands.

Although in the preferred embodiment the attachment is open at both ends to allow simultaneous steaming of several body parts, the invention could also be practiced using a conduit that was closed at both ends to provide a flow of steam treatment only through the top of the conduit or closed at only one end to provide a horizontal flow of steam. Alternatively, the invention could be practiced by dispensing with the holes 63 so that the attachment directed steam only through the ends.

A shown in FIGS. 9–12, in,another embodiment of the current invention, the conduit 160 is more securely attached to the steamer 101 by locking tabs 201 that extend between the conduit and the steamer 101. As shown in FIGS. 9 and 10, two locking tabs 201 extend from opposing longitudinally extending sides of the conduit 160. As shown in FIG. 12, each of the tabs 201 is flexibly attached to the conduit by means of a flexible hinge 206. The hinge 206 is formed by locally weakening the tab 201 by reducing its thickness between a stationary portion 205 and a deflecting portion 207. The hinge 206 allows the deflecting portion 207 to deflect relative to the conduit 160 in a radial plane. This deflection allows an opening 203 in the end of the tab 201 to be snapped over a retainer 200 projecting from a lip 180 formed at the opening of the vessel 124.

As shown in FIG. 11, the retainer 200 has a shank portion 209 and a head portion 208. In the preferred embodiment, the head 208 is slightly larger than the opening 203 in the tab 201. This allows the tab 201, which is preferably made from a plastic material, to secured to the retainer by a "snap fit"—that is, the portion around the tab opening 203 is elastically deformed so that the opening slips over the retainer head 208 and is retained on the shank 209. As shown in FIG. 11, in the preferred embodiment, beveled edges 204 are formed on the retainer head 208 to facilitate snapping the tab opening 203 over the head.

The present invention may be embodied in other specific forms without departing from the spirit or essential attributes thereof and, accordingly, reference should be made to the appended claims, rather than to the foregoing specification, as indicating the scope of the invention.

What is claimed:

1. A steamer for steam treating a user's body, comprising:

a) a steam flow generating unit having (i) a vessel forming a cavity for containing water, and (ii) means for transforming at least a portion of said water contained in said cavity to a flow of steam; and b) steam flow directing means having (i) steam flow discharging means for directing at least a first portion of said steam flow from said steam flow generating unit in a first substantially horizontal direction, and (ii) means for locking said steam flow directing means onto said steam flow generating unit.

2. The steamer according to claim 1, wherein said locking means comprises:

a) a tab extending between said steam flow directing means and said steam flow generating unit; and b) a retainer for releasably securing said tab.

3. The steamer according to claim 2, wherein said tab is attached to said steam flow directing means and said retainer is attached to said steam flow generating unit.

4. The steamer according to claim 3, wherein said tab is attached to said steam flow directing means by flexible bending means.

5. The steamer according to claim 2, wherein said tab is a first tab and said retainer is a first retainer, and wherein said locking means further comprises:

a) a second tab extending between said steam flow directing means and said steam flow generating unit; and b) a second retainer for releasably securing said tab.

6. The steamer according to claim 2, wherein said tab has a flexible hinge formed therein for allowing at least a portion of said tab to deflect relative to said steam flow directing means.

7. The steamer according to claim 2, wherein said retainer comprises a member having a shank portion attached thereto and a head portion formed at a distal end of said shank portion.

8. The steamer according to claim 7, wherein said member projects from said steam generating unit.

9. The steamer according to claim 2, wherein said tab has an opening formed therein adapted to receive said retainer.

10. The steamer according to claim 9, wherein tab opening is smaller than at least a first portion of said retainer, and wherein at least a portion of said tab adjacent said opening is elastically deformable, whereby said tab is secured by said retainer by snapping said tab opening over said first portion of said retainer.

11. The steamer according to claim 2, wherein said steam flow directing means comprises a conduit having (i) first and second ends, a first opening formed at said first end and forming said steam flow discharging means, and (ii) a longitudinally extending side between said first and second ends, and wherein said tab is attached to said longitudinally extending side.

12. The steamer according to claim 11, wherein said conduit has a second opening formed in said longitudinally extending side for directing a second portion of said steam flow from said steamer in a substantially vertically upward direction.

13. The steamer according to claim 11, wherein said conduit has a second opening formed at said second end for directing a second portion of said steam flow from said steamer in a second substantially horizontal direction.

14. The steamer according to claim 1, wherein said steam generating unit has a first steam port for discharging said flow of steam as a jet of said steam into said steam flow directing means.

15. A steamer for supplying steam to hair curlers and for steaming a user's body, comprising:

a) a steam generating unit having means for generating a steam flow and for directing said steam flow to a hair curler; and b) a conduit for directing said steam flow from said steam flow directing means to a user's body, said conduit having:

(i) a first opening for receiving said steam flow from said steam flow directing means;

(ii) second and third openings for discharging first and second portions of said steam flow received, said second and third openings oriented so as to simultaneously direct said first and second portions of said steam flow in first and second directions, respectively, whereby first and second portions of said body can be simultaneously steam treated; and (iii) means for locking said conduit onto said steam generating unit.

16. The steamer according to claim 15, wherein said locking means comprises a tab extending from said conduit.

17. The steamer according to claim 15, wherein said tab has an opening formed therein.

18. The steamer according to claim 16, wherein said tab is flexibly attached to said conduit.

19. A steamer for providing steam to a hair curler when operating in a first mode and for providing steam to one's body when operating in a second mode, comprising:

a) a steam generating unit having means for generating a steam flow and for discharging said steam flow as a jet of steam directed substantially upwardly to a hair curler when operating in said first mode; and b) means for diffusing said steam jet and for directing at least a portion of said steam jet to said body when operating in said second mode; and c) means for releasably locking said diffusing means onto said steam generating unit.

20. The steamer according to claim 19, wherein said locking means comprises:

a) a tab extending between said diffusing means and said steam generating unit; and b) a retainer for releasably securing said tab by means of a snap fit.

* * * * *

UNITED STATES PATENT AND TRADEMARK OFFICE

CERTIFICATE OF CORRECTION

PATENT NO. : 5,355,591

DATED : October 18, 1994

INVENTOR(S) : Caruso

It is certified that error appears in the above-identified patent and that said Letters Patent is hereby corrected as shown below:

Column 1, line 31, please delete "Steamer" and insert therefor --steamer--;
Column 4, line 28, please delete "Streams" and insert therefor --streams--;
Column 5, line 24, please delete "in,another" and insert therefor --in another--;
Column 5, line 45, please insert the word --be-- before the word "secured".

Signed and Sealed this

Fourteenth Day of February, 1995

*Attest:*

*Attesting Officer*

Bruce Lehman

BRUCE LEHMAN

*Commissioner of Patents and Trademarks*